US010378317B2

(12) United States Patent
Vachon

(10) Patent No.: US 10,378,317 B2
(45) Date of Patent: Aug. 13, 2019

(54) FCD MODELING

(71) Applicant: CONOCOPHILLIPS COMPANY, Houston, TX (US)

(72) Inventor: Guy Vachon, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 570 days.

(21) Appl. No.: 15/197,132

(22) Filed: Jun. 29, 2016

(65) Prior Publication Data

US 2016/0376873 A1 Dec. 29, 2016

Related U.S. Application Data

(60) Provisional application No. 62/186,119, filed on Jun. 29, 2015.

(51) Int. Cl.

| | |
|---|---|
| ***G06G 7/48*** | (2006.01) |
| ***E21B 41/00*** | (2006.01) |
| ***E21B 34/06*** | (2006.01) |
| ***E21B 43/24*** | (2006.01) |
| ***E21B 43/12*** | (2006.01) |

(52) U.S. Cl.

CPC ..... *E21B 41/0092* (2013.01); *E21B 34/06* (2013.01); *E21B 43/12* (2013.01); *E21B 43/2406* (2013.01)

(58) Field of Classification Search

None

See application file for complete search history.

(56) References Cited

U.S. PATENT DOCUMENTS

| | | | | |
|---|---|---|---|---|
| 8,527,100 | B2 | 9/2013 | Russell et al. | |
| 2004/0167726 | A1* | 8/2004 | Rouss | F15B 19/007 702/50 |
| 2008/0262735 | A1* | 10/2008 | Thigpen | E21B 43/32 702/6 |
| 2008/0262737 | A1* | 10/2008 | Thigpen | E21B 43/00 702/9 |
| 2011/0146975 | A1* | 6/2011 | O'Malley | E21B 34/14 166/250.15 |
| 2011/0226469 | A1* | 9/2011 | Lovell | E21B 47/1005 166/250.01 |
| 2014/0275839 | A1* | 9/2014 | Kron | A61B 5/6834 600/301 |

(Continued)

OTHER PUBLICATIONS

Sylvian Ferro Modeling Inflow Control Devices in Gas Condensate Reservoirs with Reservoir Simulation Norwegian University of Science and Technology (NTNU) (Year: 2010).*

(Continued)

*Primary Examiner* — Rehana Perveen
*Assistant Examiner* — Cuong V Luu
(74) *Attorney, Agent, or Firm* — ConocoPhillips Company

(57) ABSTRACT

The present disclosure relates to passive flow control devices or FCDs and modeling methods applicable to same. In particular, a new method to extrapolate the value of a reference FRR tool to other tools with the same architecture, but different ratings. Instead of scaling the output of the model, the data of the available characterizations is used to extrapolate what the characterization results would be to the different FRR. This estimated data set is then used to fit a new model for the uncharacterized FRR tool.

11 Claims, 5 Drawing Sheets

(56) References Cited

U.S. PATENT DOCUMENTS

| | | | | |
|---|---|---|---|---|
| 2015/0013980 | A1* | 1/2015 | Duphorne | E21B 43/12 166/276 |
| 2015/0161304 | A1 | 6/2015 | Vachon | |
| 2015/0275688 | A1* | 10/2015 | Barenbrugge | F01D 21/003 73/112.02 |
| 2015/0370934 | A1* | 12/2015 | Pride | G06F 17/5009 703/10 |
| 2016/0281494 | A1* | 9/2016 | Shirdel | E21B 43/24 |

OTHER PUBLICATIONS

Youngs et al. Recent Advances in Modeling Well Inflow Control Devices in Reservoir Simulation International Petroleum Technology Conference, IPTC (Year: 2009).*

Zheng et al. A Novel Autonomous Inflow Control Device Design and Its Performance Predictions Journal of Petroleum Science and Engineering 126, pp. 35-47 (Year: 2014).*

Faisal Turki Manee Al-Khelaiwi A Comprehensive Approach to the Deisgn of Advanced Well Completions Insitute of Petroleum Engineering, Heriot-Watt University, Edinburgh, Scotland, UK (Year: 2013).*

SPE-153706 (2012) Stalder, Test of SAGD Flow Distribution Control Liner System, Surmont Field, Alberta, Canada.

SPE:170045-MS (2014) Reil, et al., An Innovative Modeling Approach to Unveil Flow Control Devices' Potential in SAGD Application.

Zeng Q. et al., Comparative Study on Passive Flow control Devices by Numerical Simulation, Tech Science Press SL 9(3): 169-180 (2013), available online at www.techscience.com/doi/10.3970/sl.2013.009.169.pdf.

Birchenko V.M., Analytical Modelling of Wells with Flow Control Devices (PhD Thesis 2010), available at www.ros.hw.ac.uk/bitstream/10399/2349/1/BirchenkoV_0710_pe.pdf.

OTC-19811-MS (2009) Coronado, et el., New Inflow Control Device Reduces Fluid Viscosity Sensitivity and Maintains Erosion Resistance.

* cited by examiner

FIGURE 1: (prior art)
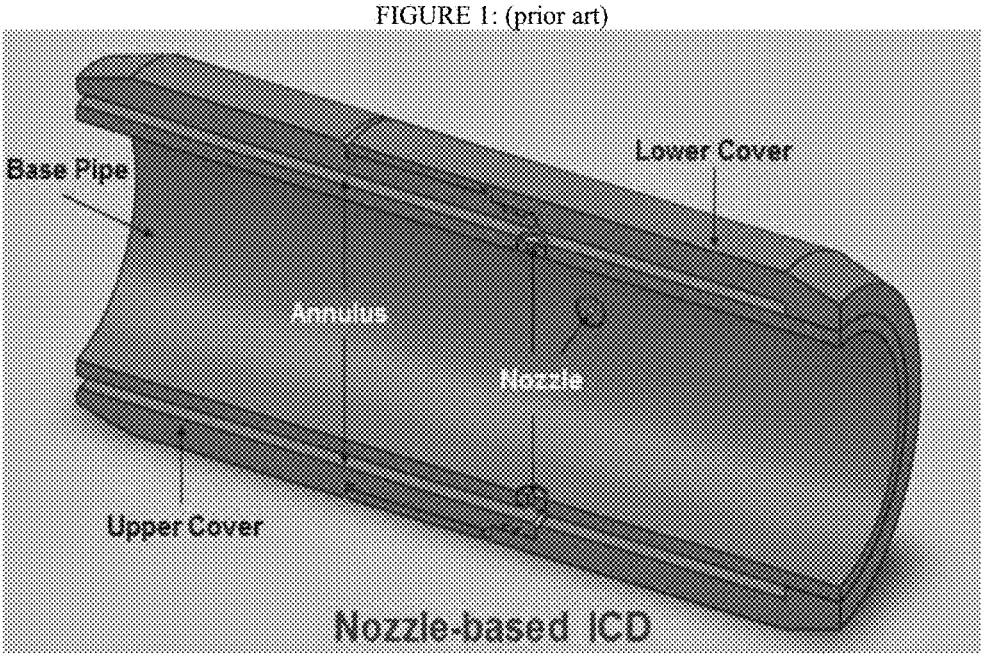

FIGURE 2: (prior art)
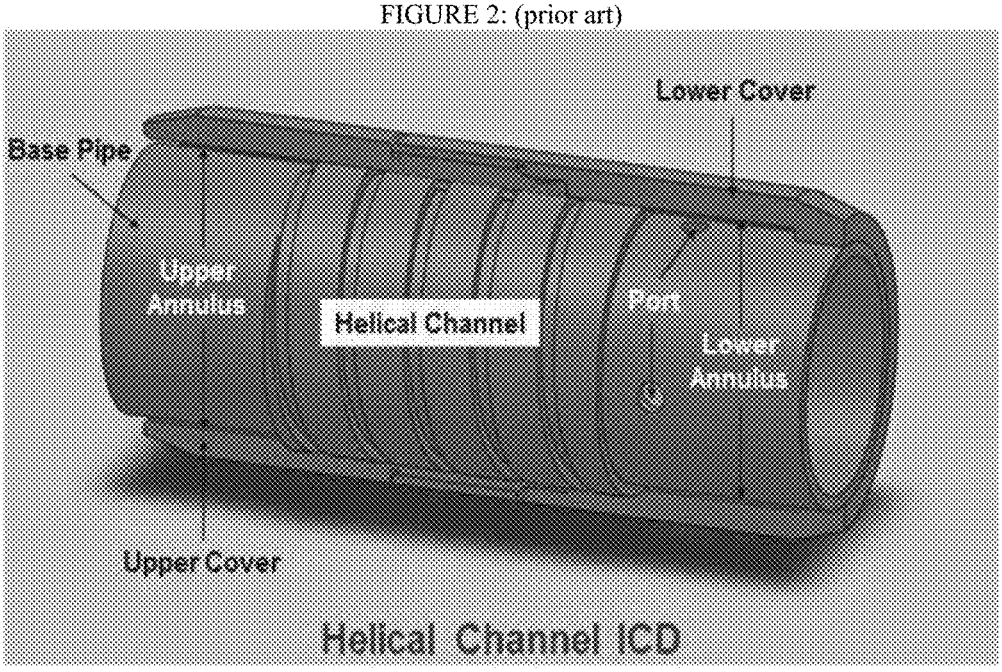
FIGURE 3: (prior art)
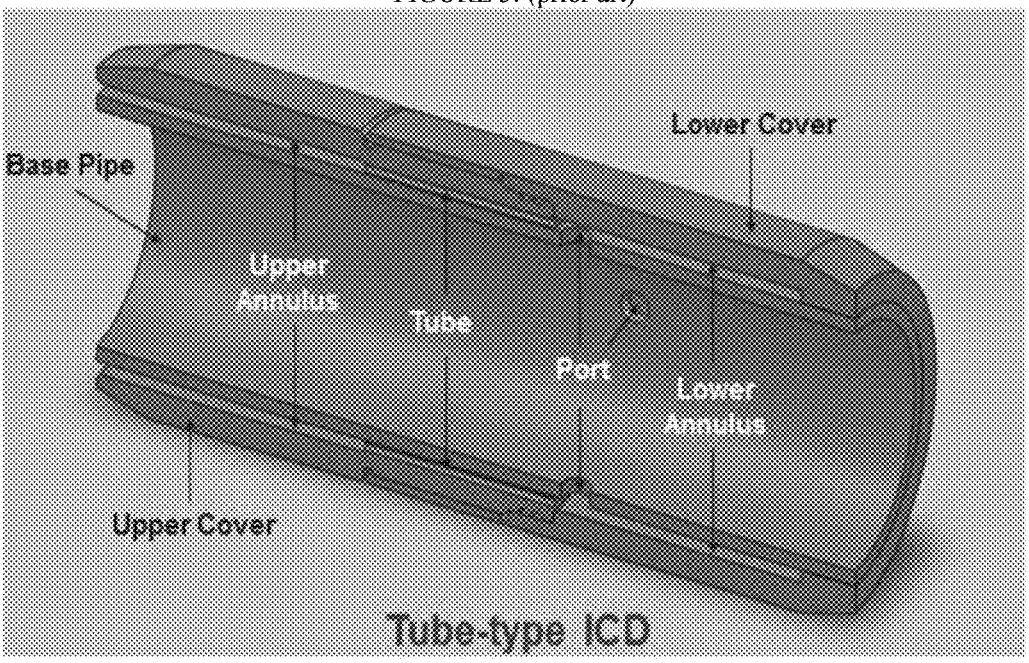

FIGURE 4: (prior art)
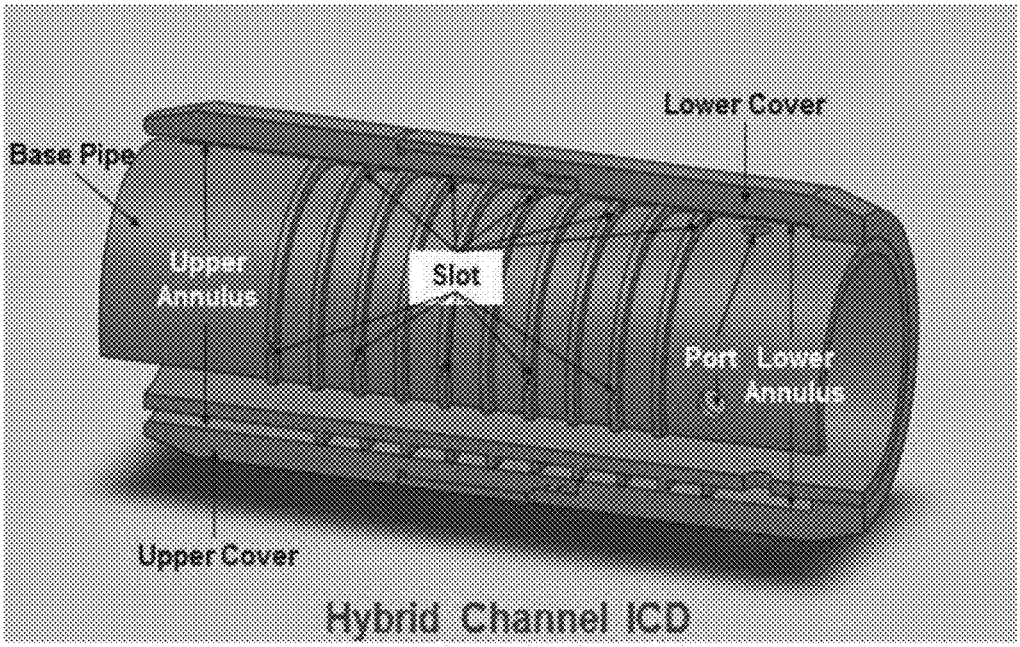

FCD MODELING

PRIORITY CLAIM

This application is a non-provisional application which claims benefit under 35 USC § 119(e) to U.S. Provisional Application Ser. No. 62/186,119 filed Jun. 29, 2015, entitled "FCD MODELING," which is incorporated herein in its entirety.

FEDERALLY SPONSORED RESEARCH STATEMENT

Not Applicable.

REFERENCE TO MICROFICHE APPENDIX

Not applicable.

FIELD OF THE DISCLOSURE

This disclosure relates generally to methods of modeling flow control device performance, so that the models can be used to predict FCD behavior, or be used in reservoir simulations to predict well behavior, especially as relates to steam based enhanced oil recovery methods.

BACKGROUND OF THE DISCLOSURE

In long horizontal wells, the production rate at the heel is often higher than that at the toe. The resulting imbalanced production profile may cause early water or gas breakthrough into the wellbore. Once coning occurs, well production may severely decrease due to limited flow contribution from the toe. To eliminate this imbalance, flow control devices (FCDs) are placed in each screen joint to balance the production influx profile across the entire lateral length and to compensate for permeability variations. By restraining, or normalizing, flow through high flow rate sections, FCDs create higher drawdown pressures and thus higher flow rates along the borehole sections that are more resistant to flow. This corrects uneven flow caused by the heel-toe effect and heterogeneous permeability.

Currently, there are four primary types of passive FCD designs in the industry: nozzle-based (restrictive) (FIG. 1), helical channel (frictional) (FIG. 2), tube-type (combination of restrictive and friction) (FIG. 3) and hybrid channel (combination of restrictive, some friction and a tortuous pathway) (FIG. 4). They use four different methods to generate the pressure drop that helps to normalize flow.

The nozzle-based FCD uses fluid constriction to generate an instantaneous differential pressure across the device by forcing the fluid from a larger area down through small diameter port, creating a flow resistance. The benefits of nozzle-based FCD are its simplified design and easier nozzle adjustment immediately before deployment in a well should real-time data indicate the need to change flow resistance. The disadvantage of nozzles is that small diameter ports are required to create flow resistance, which make them prone to erosion from high-velocity fluid-borne particles during production and susceptible to plugging, especially during any period where mud flow back occurs.

The helical channel FCD uses surface friction to generate a differential pressure across the device. The helical channel design is one or more flow channels that wrapped around the base pipe. This design provides for a distributed pressure drop over a relatively long area, versus the instantaneous loss using a nozzle. Because the larger cross-sectional flow area of the helical channel FCD generates significantly lower fluid velocity than the nozzles of a nozzle-based FCD with a same flow resistance rating ("FRR"), the helical channel FCD is more resistance to erosion from fluid-borne particles and resistant to plugging during mud flow back operations. The disadvantage of helical-channel FCD is that its flow resistance is more viscosity-dependent than the nozzle-based FCD, thus start-up in a steam based method, such as SAGD, can be delayed. The cost of delayed production has been estimated at $2M/month (assuming production is completely restricted for a month). The viscosity dependence could also allow preferential water flow should premature water breakthrough occur. Also, the helix FCD is not adjustable.

The tube-type FCD design incorporates a series of tubes. The primary pressure drop mechanism is restrictive, but in long tubes. This method essentially forces the fluid from a larger area down through the long tubes, creating a flow resistance. Because of the additional friction resistance, the larger cross-sectional flow area of the tube-type FCD generates lower fluid velocity than the nozzles of a nozzle-based FCD with a same FRR, the tube-type FCD is more resistance to erosion from fluid-borne particles and resistant to plugging during mud flow back operations. However, since the friction resistance is much less than the local resistance, the tube-type FCD is less viscosity-dependent than a helical channel FCD having the same FRR.

The hybrid FCD design incorporates a series of flow slots in a maze pattern. Its primary pressure drop mechanism is restrictive, but in a distributive configuration. A series of bulkheads are incorporated in the design, each of which has one or more flow cuts at an even angular spacing. Each set of flow slots are staggered with the next set of slots with a phase angle thus the flow must turn after passing through each set of slots. This prevents any jetting effect on the flow path of the downstream set of slots, which may induce turbulence. As the production flow passes each successive chamber that is formed by bulkheads, a pressure drop is incurred. Pressure is reduced sequentially as the flow passes through each section of the FCD. Without the need to generate the pressure drop instantaneously, the flow areas through the slots are relatively large when compared to the nozzle design of same FRR, thus dramatically reducing erosion and plugging potential.

Although FCDs are a well-developed completion technology, they have only recently been applied to enhanced oil recovery methods, such as SAGD. SAGD is the most extensively used concept for in situ development of the million plus centipoises bitumen resources in the McMurray Formation in the Alberta Oil Sands. SAGD uses long horizontal well pairs, with a horizontal producer located near the bottom of the pay and a horizontal steam injector typically spaced about five meters (4-10 m) above, and parallel to, the producer. Steam is continuously injected into both wells during start-up to form a steam chamber along the length of the wells and establish fluid communication between the well pair. Once the steam chamber is well developed and the well pair are in fluid communication, steam is typically only injected into the injection well. Heavy oil heats at the edges of the steam chamber, gravity drains to the lower production well, where it and any condensed water are then produced.

Even development of the steam chamber is needed in SAGD, and the well completion is designed to optimize this. The standard SAGD well design used at Surmont, for example, employs 800 to 1000 meter slotted liners with tubing strings landed near the toe and near the heel in both the injector and the producer to provide two points of flow distribution control in each well. Steam is injected into both tubing strings at rates that are controlled so as to place more or less steam at each end of the completion, thus achieving better overall steam distribution along the horizontal wells.

Likewise, the producer is initially gas-lifted through both tubing strings at rates controlled to provide better inflow distribution along the completion. If steam were injected only at the heel of the injector, and water and bitumen were produced only from the heel of the producer, the tendency would be for the steam chamber to develop only near the heel. This would result in limited rates and poor steam chamber development over much of the horizontal completion. Indeed, even with toe tubing strings, seismic surveys indicate that steam chamber growth is uneven, and typically there is only about 50% conformance.

Stalder was the first to investigate and publish a study of the flow distribution control of FCDs in a SAGD reservoir. See SPE-153706-MS (2012). For that test, toe tubing was used during preheat, but removed for the test. The producer liner consisted of 59 joints of 6⅝ inch base pipe, each having a helical channel FCD and a 17 feet long sand exclusion element. The injector liner consisted of 62 joints of 6⅝ inch base pipe, of which 41 joints had a helical channel FCD with a six inch wire-wrapped screen sand exclusion element, and 21 joints were blank pipe spaced throughout the liner. Each liner joint was 47 feet long in both the producer and the injector.

The typical liner design in this reservoir has slots cut throughout the surface of every joint of liner in both the producer and the injector, except for a short length near each coupling, so that over 90% of the liner length is slotted. In contrast, the FCD test had only a fraction open for fluid flow. In the producer only 36% of the length of the liner was open screen and 64% was blank pipe. The injector liner was only 0.7% open screen, and 99.3% was blank pipe.

Based on the observations of the above helical channel FCD-deployed SAGD well pair, Stalder concluded that an FDC-deployed single tubing completion achieved similar or better steam conformance as compared to the standard toe/heel tubing injection. In addition, the FCD completion significantly reduced tubing size, which in turn reduced the size of slotted liner, intermediate casing, and surface casing. The smaller wellbore size increased directional drilling flexibility and reduced drag making it easier and lower cost to drill the wells. Thus, Stalder concluded wells could be drilled much longer than current SAGD wells, which tend to be between 500 and 1000 m.

Although all FCD's offer benefit, the reality is that none of these FCDs meets the ideal requirements of an FCD designed for the life of a SAGD well—high resistance to plugging and erosion, high viscosity insensitivity, and yet at the same time allows for flow control of the more complex flow profiles from enhanced oil recovery methods, such as SAGD where oil viscosity is higher during startup, where temperatures have not yet reached a high, but viscosity reduces as the temperature increases and where steam flashing is a potential problem. Therefore, the selection and optimization of FCDs for specific reservoirs, especially heavy oil reservoirs, is still needed in the art.

To gain the potential economic benefits from an FCD and to select the most appropriate FCD device for a given situation, a need to better understand FCD behavior in SAGD operations has been expressed by several SAGD operators. However, characterization data from vendors tends to be limited and sporadic. In all cases the rate/pressure relationships for the FCDs were available only for liquid water or oil at low temperature, not for steam and high temperature oil conditions present in a SAGD well. Yet, steam flashing is a critical parameter to consider in any steam based oil recovery method.

Initial characterization of FCDs often relates the pressure drop across the tool as a function of the Reynolds Number (Re). This relationship between ΔP and Re has been the most advanced formulation to represent FCDs in a thermal reservoir simulator. However, this approach is only valid as long as no phase change occurs through the device (water flashing to steam for example).

Thus, what is still needed in the art are better modeling methods to predict the FCD behavior under reservoir conditions, particularly under enhanced oil recovery conditions such as seen with SAGD. In particular, a method to better account for behavior under the unique conditions presented by steam based enhanced recovery methods would be beneficial.

SUMMARY OF THE DISCLOSURE

Reservoir simulation relies on integrated wellbore hydraulics and reservoir models, such as STARS-FLEXWELL from Computer Modeling Group, ECLIPSE software with Segmented Well from Schlumberger, NEXUS with SURFNET software from Halliburton, PROSPER with REVEAL software from Petroleum Experts or other commercially available reservoir models. The reservoir models require a description of the behavior of the FCD in the operating conditions. However, understanding the behavior of the FCD and how to account for such behavior becomes limited when the subcool (i.e., difference between injected steam and the produced fluids) approaches zero and the water in the reservoir begins to flash in the producer.

We have developed a model for use in predicting FCD behavior in the complex well completion of a SAGD reservoir that accounts for the steam flashing that occurs when the well is run at close to zero subcool. See e.g., SPE: 170045-MS (2014). See also, U.S. Ser. No. 14/562,299 filed Dec. 5, 2014.

Generally speaking, our modeling assumes that any FCD, no matter how it is built, can be modeled as a series of nozzles or chokes with a series of open chambers. The chokes are assumed to see pressure change, but no phase change, and the chambers see no pressure change, but only phase change.

We have characterized FCDs of different architectures using the above method, but to date we have only characterized a single FRR (flow resistance rating—a rating of how much ΔP the FCD will generate) of those FCDs available for testing. As our characterization program progresses, it is impractical to characterize all FRRs for the various architectures of FCD, because the existing modeling program can take anywhere from a few hours to days to complete and because FCDs with a wide variety of FRRs are not even available for testing. A procedure is thus required to extrapolate the characterization of one FRR to other FRRs.

The simple solution would be to just scale the ΔP produced by the model of the FRR that was characterized. This approach, however, fails because the models are not designed to predict negative pressures and thus limit the ΔP to at most the inlet pressure at any given set of conditions.

If limited by the inlet pressure, the ΔP will appear artificially low when scaled. For example, inlet P is 600 psi and the reference tool that is being characterized has an FRR 3.2. For some conditions like high flow and/or high steam quality, the ΔP is limited to 600 psi. If this is to be scaled to an FRR of 0.4, 600 divided by 8 yields a maximum ΔP of 75 psi. Yet under those conditions, the 0.4 FRR could produce a higher ΔP than 75 psi, thus this approach does not produce a good extrapolation of behavior.

Another possible solution is to scale the parameters of the model. This fails to account for differing thermodynamic behavior, however, and does not capture how the different FRR tools impact steam flashing differently. Thus, this method is not satisfactory either.

We have found that a better way to extrapolate to different FRR is to scale the data of the reference tool, then go through the exercise of fitting the model on this modified dataset. If only one FRR has been characterized, the data is scaled. If several FRRs have been characterized, the data is interpolated from the available results.

Different measurements capture different properties of an FCD. For example, we may choose to perform separate tests in order to study the varying effects of viscosity sensitivity, reactivity to flow changes in monophasic flow and steam blocking efficacy on the performance of the device. In a test program, for example, viscosity sensitivity can be studied by performing oil tests at various temperatures. Reactivity to flow changes in monophasic flow can be studied by performing unsaturated water flow tests at two or more flow rates. Steam blocking efficacy can be studied by steam tests at varying steam percentage. This data is all collected, preferably for more than one FRR rating.

Because each parameter responds differently to changes, each type of data collected will scale differently. Once the oil/water/steam data is separately captured, that data can be used to scale the oil, water and steam data by different factors to estimate their values at a new FRR. If more than 2 sizes of tool are tested, they may even be scaled using an exponential or a polynomial extrapolation and interpolation.

The scaled data set is then used to optimize a model for the interpolated or the extrapolated FRR. Ideally the data from the lowest, highest and middle FRRs would be used but the described approach works even if other FRR values are used. Of course, the more FRRs tested, the more accurate the results. The fitted model can then be used to predict performance of different FCD devices at differing FRRs, but can also be used in a reservoir simulator to predict production performance under the varying conditions.

The invention can comprise any one or more of the following embodiments, in any combination(s) thereof:

A method of modeling the behavior of a flow control device (FCD), comprising:

a) obtaining a first reference FCD of a given architecture;

b) measuring performance data from said reference FCD at a first flow resistance rating (FRR) to produce a first dataset;

c) measuring performance data from said first reference FCD at a second FRR to produce a second dataset;

d) using the first and second data set to estimate a modified dataset corresponding to a third FRR;

e) fitting a model to said modified dataset to produce a fitted model; and f) using said fitted model to produce a prediction of FCD behavior of the reference FCD at said third or a fourth FRR.

A method of modeling the behavior of an FCD, comprising:

a) obtaining a first reference FCD of a given architecture;

b) measuring performance data from said reference FCD at a first FRR to produce a first dataset, wherein said first dataset includes oil tests at two or more temperatures, unsaturated water flow tests at two or more pressures, and steam tests at two or more steam percentages;

c) measuring performance data from said reference FCD at a second FRR to produce a second dataset, wherein said second dataset includes oil tests at two or more temperatures, unsaturated water flow tests at two or more pressures, and steam tests at two or more steam percentages;

d) using the first and second data set to estimate a modified dataset corresponding to a third FRR, wherein data from oil tests, unsaturated water flow tests and steam tests are each scaled separately;

e) fitting a model to said modified dataset to produce a fitted model; and f) using said fitted model producing a prediction of FCD behavior of the reference FCD at said third FRR or a fourth FRR.

A method as herein described, wherein said performance data includes measuring FCD performance at two or more viscosities, two or more steam qualities, and two or more pressures, and wherein each is separately scaled to generate a modified dataset.

A method as herein described, wherein said model predicts a differential pressure of a fluid that includes both water and steam through stages separated by chokes of a well flow control device based on the following equation (EQ. 1) to estimate the amount of steam that flashes:

$$((HLi-HLo)/(HVo-HLo))*Sk, \quad \text{(EQ. 1)}$$

where HLi is liquid enthalpy at pressure going in the choke, HLo is liquid enthalpy at pressure out of the choke, HVo is vapor enthalpy at pressure out of the choke and Sk is a scaling factor for amount of the steam that is released between the stages; and simulating hydrocarbon production using the differential pressure that is predicted.

A method as herein described, wherein said fitted model is used to predict the performance of a steam assisted gravity drainage (SAGD) well.

A method as herein described, wherein said fitted model is used to predict the performance of a steam based oil recovery well.

A method of predict the performance of a SAGD well completed with a plurality of FCDs, comprising:

a) obtaining a first reference FCD of a given architecture;

b) measuring performance data from said reference FCD at a first flow resistance rating (FRR) to produce a first dataset;

c) measuring performance data from said reference FCD at a second FRR to produce a second dataset;

d) using the first and second data set to estimate a modified dataset corresponding to a third FRR;

e) fitting a model to said modified dataset to produce a fitted model; and f) using said fitted model to predict the performance of the reference FCD at a third FRR or a fourth FRR;

g) using said model in a reservoir simulator model to predict the production performance of a SAGD well fitted with test FCDs having a test FRR.

A method as herein described, wherein a variety of test FRRs are tested in step g or a variety of test FCDs having different architectures are tested in step g, or both.

As used herein, flow control device "FCD" refers to all variants of tools intended to passively control flow into or out of wellbores by choking flow (e.g., creating a pressure drop). The FCD includes both inflow control devices "ICDs"

when used in producers and outflow control devices "OCDs" when used in injectors. The restriction can be in form of channels or nozzles/orifices or combinations thereof, but in any case the ability of an FCD to equalize the inflow along the well length is due to the difference in the physical laws governing fluid flow in the reservoir and through the FCD. By restraining, or normalizing, flow through high-rate sections, FCDs create higher drawdown pressures and thus higher flow rates along the bore-hole sections that are more resistant to flow. This corrects uneven flow caused by the heel-toe effect and heterogeneous permeability.

By "architecture" herein, we refer to the physics and geometry of the mechanism to generate ΔP in an FCD. See e.g. FIG. 1-4 showing various common architectures.

By "scaling" a data set, it means to estimate the test results that would have been obtained with a tool of greater or lesser restriction, e.g., a simple example would be a device might have double the flow if the nozzle has twice the area.

By "extrapolating" we mean estimating a value based on extending a known sequence of values or facts beyond the area that is certainly known.

By "interpolating" we mean estimating a value within two known values in a sequence of values.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein (Table 1):

TABLE 1

| Abbreviations | |
|---|---|
| ΔP | Pressure drop (psi) |
| bbl | Oil barrel, bbls is plural |
| CFD | Computational fluid dynamics |
| CSOR | Cumulative steam to oil ratio |
| CSS | Cyclic steam stimulation |
| CWE | Cold water equivalent |
| ES-SAGD | Expanding solvent-SAGD |
| FCD | Flow control device - see also ICD and OCD |
| FISHBONE-SAGD | SAGD using wells with multilaterals |
| FRR | Flow resistance rating |
| ICD | Inflow control device |
| ID | Inside diameter |
| OCD | Outflow control device |
| OD | Outside Diameter |
| OOIP | Original oil in place |
| RADIAL SAGD | SAGD wherein wells radiate out form a single pad |
| Re | Reynolds number |
| SAGD | Steam assisted gravity drainage |
| SD | Steam drive |
| SOR | Steam to oil ratio |
| SW-SAGD | Single well SAGD |
| VBA | Visual Basic for Applications |

TABLE 1-continued

| Abbreviations | |
|---|---|
| XSAGD | Cross SAGD (injectors and producers arranged perpendicularly |

BRIEF DESCRIPTION OF THE DRAWINGS

FIG. 1 shows a nozzle-type FCD.

FIG. 2 shows a helical pathway-type FCD.

FIG. 3 shows a tube-type FCD.

FIG. 4 shows a hybrid channel FCD, which is part helical pathway and part slots, wherein the slots appear at intervals in the helical pathway.

DESCRIPTION OF EMBODIMENTS

The present disclosure provides a new method to extrapolate or interpolate the value of a reference FRR tool to other tools with the same architecture, but different ratings. Instead of scaling the output of the model, the data of the available characterizations is used to scale what the characterization results would be to the different FRR. The new scaled values are designed to respect the trends in viscosity dependence, reactivity to flow and steam block observed in the different characterized tools of this architecture. The estimated data set will have the predicted values for these attributes at the new FRR. This estimated data set is then used to form a new model for the uncharacterized FRR tool, which is then used to predict performance of the new, uncharacterized tool. An FCDs responses to changing viscosity, water flow rate, and steam % are not consistent (or linear), and thus the best models can be obtained by scaling each of these responses separately.

Model to Estimate ΔP

FCDs have very complex behavior but their purpose is to generate ΔP across them. This pressure differential can improve production by delaying or inhibiting undesired outcomes like steam breakthrough. They can also inhibit production if misapplied. The ΔP depends on the properties and conditions of the flow:

- Viscosity/Density of fluid
- Flow rate
- Steam fraction
- Emulsion properties—Water in oil vs oil in water inversion
- Substantial changes in behavior are suspected when emulsions go from water in oil to oil in water. These effects must be verified and quantified.

Another factor that affects ΔP is the flow regime. It is assumed that FCDs operate in turbulent flow, which means with Reynold's numbers greater than 2,000 to 4,000.

Traditional tools to estimate ΔP assume it is a function of Reynold's number (Re, which incorporates flow rate, viscosity and density). Reservoir simulators rely on this assumption in their computations. However, this assumption does not hold true when there are phase transitions in the fluids (as determined by lab tests conducted under these conditions).

Figure 5:
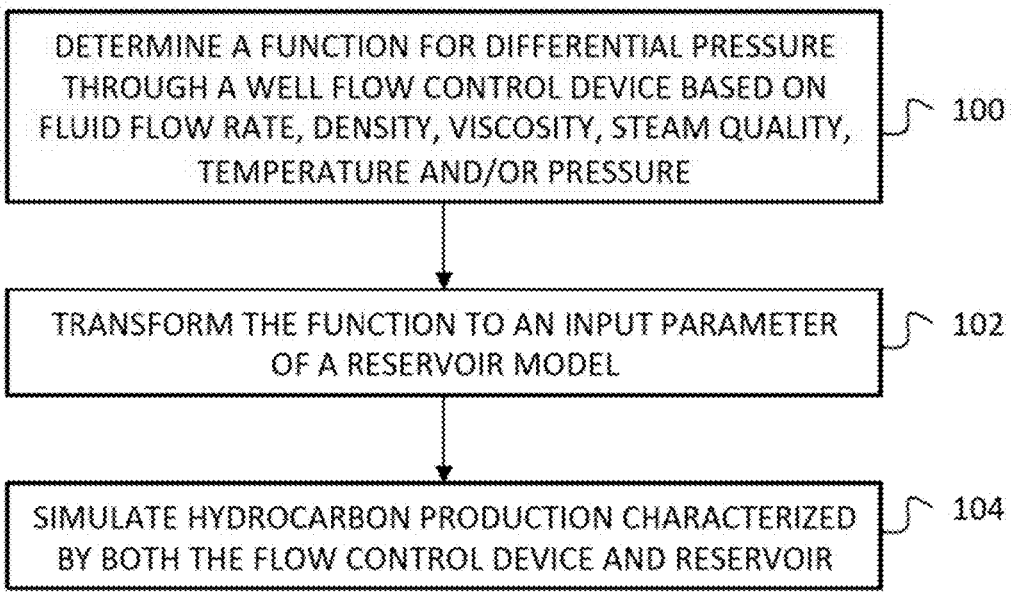
FIG. 5 is a flow diagram depicting a method of accounting for influences from a well flow control device in simulating hydrocarbon production from a reservoir, according to one embodiment of the invention.
Figure 6:
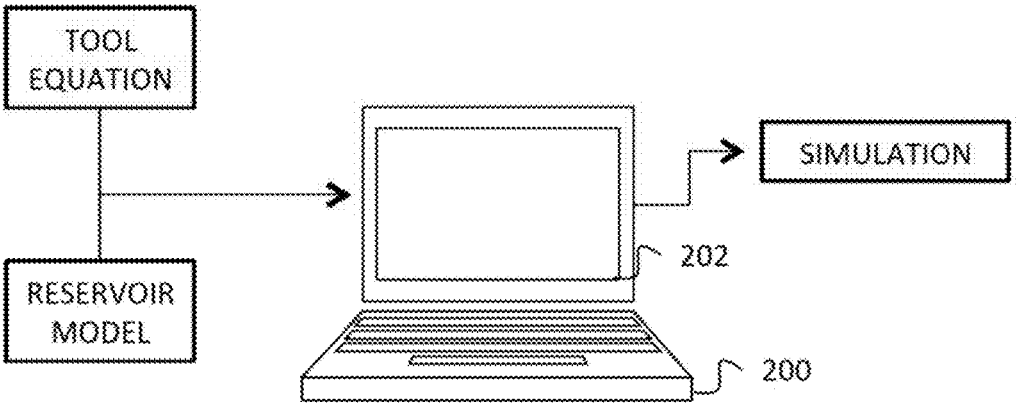
FIG. 6 is a schematic illustrating implementation of the method utilizing a system, according to one embodiment of the invention.
Figure 7:
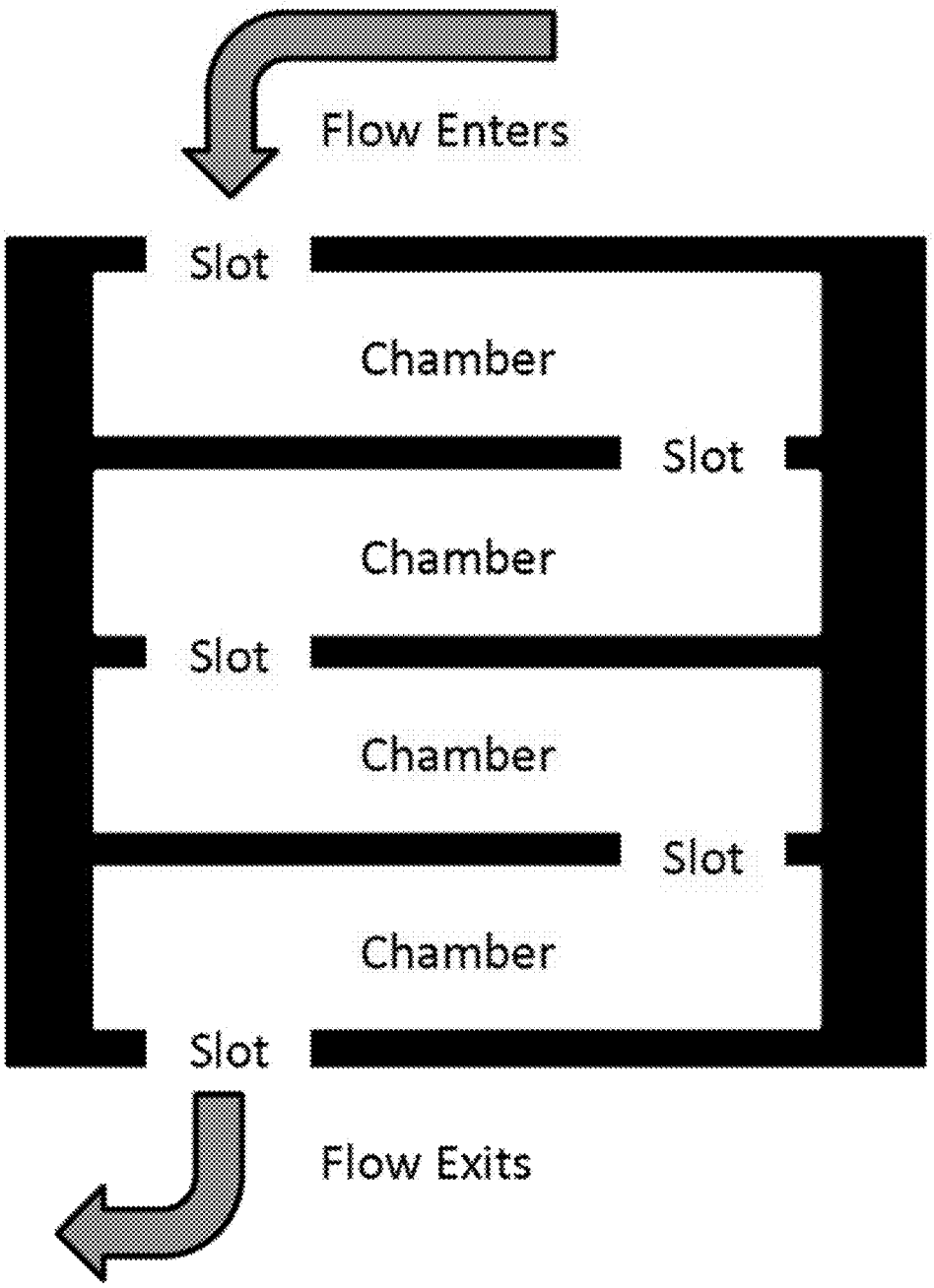
FIG. 7 demonstrates the concept for modeling FCDs is to treat the model as a series of slots followed by chambers.

In order to accommodate the effects of phase transitions, we have estimated the performance of the FCD as a cascade of orifices or chokes, applying enthalpy steam flash calculations in the spaces between orifices, as shown in FIG. 7. For each orifice, we use a flow resistance (K) term appropriate for the expected flow regime with a non-Darcy (flow rate squared) term. The computation has been done for water without using the reservoir simulator and was verified experimentally. On emulsions there should be an inert component, the bitumen, and a separate water component, so again a proper K term should be identified.

In more detail, the method begins with EQ. 2 to estimate ΔP for flow through orifices in turbulent flow:

EQ. 2: Flow Equation Through an Orifice $$\Delta P = K \times \rho \times V^2 = K \times \frac{w^2}{\rho \times A^2} \text{ using } V = \frac{w}{A \times \rho}$$

Where:

ΔP is the pressure drop across an orifice in psi

K is a dimensionless friction factor which is a function of Re and will be determined empirically ρ is the fluid's mass density in $kg/m^3$ V is the fluid's velocity in m/s w is the fluid's mass flow in kg/s A is the conduit's cross sectional area in $m^2$ EQ. 3: Formula for Re-Reynold's Number $$Re = \frac{d \times V \times \rho}{\mu}$$

d=internal diameter (mm)

V is the fluid's velocity in m/s

ρ is the fluid's mass density in kg/m3

μ=dynamic viscosity in centipoises (cP)

EQ. 4: Formula to Fit K to Re Will be Determined, but One Approximation Used in Mono-Phase Flow is as Follows:

$$K = f_1 + \frac{f_1 + f_2}{\left(1 + \left(\frac{Re}{t}\right)^c\right)^d}$$

Where $f_1 = a_1 \times Re^{b_1}$ $f_2 = a_2 \times Re^{b_2}$ $a_1$, $a_2$, $b_1$, $b_2$, c, d and t are empirical factors based on flow testing data.

The change in pressure may cause some amount of water to flash to vapor if it causes the fluid crosses the liquid to gas transition of the fluid's transition diagram.

EQ 5: The Mass Fraction that Will be Converted to Vapor:

$$\frac{h_{f@higherP} - h_{f@lowerP}}{h_{fg@lowerP}}$$

Where $h_{f@higherP}$=specific enthalpy of the fluid at the higher pressure (P) in kJ/kg $h_{f@lowerP}$=specific enthalpy of the fluid at the lower P in kJ/kg $h_{fg@lowerP}$=latent heat of evaporation of the fluid at the lower P in kJ/kg The volume of fluid will increase as the vapor phase occupies more volume than the liquid phase which will in turn cause the velocity of the fluid to increase as the greater volume will need to pass through the same area in the next slot. This change would be taken into account in the ΔP computation of the succeeding slot, and so on.

The concept for modeling FCDs is to treat it as a series of slots, chokes or nozzles, followed by chambers, as shown in FIG. 7. Of course, the actual ICD architecture differs, but this approximation allows us to simplify calculations.

The ΔP of each slot is estimated as discussed and shown in EQ. 2. The total ΔP for the device would be:

EQ. 6. Total ΔP $$\Delta P_{total} = \Delta P_{slot\ 1} + \Delta P_{chamber\ 1} + \Delta P_{slot\ 2} + \Delta P_{chamber\ 2} + \ldots + \Delta P_{slot\ n} + \Delta P_{chamber\ n}$$

The chambers are where one would account for the flashing. It is unclear if the chambers will contribute much ΔP on their own so it is assumed they are frictionless and will not contribute significantly to ΔP. The same equations would apply as for the slot albeit with a different K and A. If their area is significantly larger, the $A^2$ in the denominator of EQ. 2 by itself may render the contribution negligible. By leaving the number of stages n variable, it will be adequate to estimate ΔP, then factor in the effects of flashing and iterate n times.

Modeling the FCD as a series of chokes separated by frictionless chambers with the fluid properties adjusted between slots to account for the steam that is flashed at each step is known to be an oversimplification. For example, a single choke would seem to be insensitive to steam flashing across it, which is known be incorrect. There is steam flashed at each step of the process. It is also known that the chambers between slots are not frictionless and that the torturous nature of the path creates turbulence and other effects that influence the resulting ΔP and thus the amount of flashing.

Because of the above simplification, we next applied a steam flash correction. The water mass fraction that is converted to steam at each intermediate stage of the multi-slot model of the FCD was initially estimated using EQ. 5. A factor Sk is now introduced to compensate for other effects, resulting in the following:

EQ. 7—Adjusted Steam Fraction Computation:

$$\frac{(h_{f@higherP} - h_{f@lowerP}) \times Sk}{h_{fg@lowerP}}$$

Where $h_{f@higherP}$=specific enthalpy of the fluid at the higher pressure in kJ/kg $h_{f@lowerP}$=specific enthalpy of the fluid at the lower pressure in kJ/kg $h_{fg@lowerP}$=latent heat of evaporation of the fluid at the lower pressure in kJ/kg Sk=a dimensionless scaling factor to the steam fraction Sk is intended to summarize many factors so is not related to any one physical phenomenon in particular. It is adjusted in the process of training the model.

Black Box Model

The multi-slot refinement was intended to more closely model the physics of the FCD. As noted above, some deviations were expected due to some of the simplifying assumptions that were made. The model is then trained on the data obtained from FCD measurements in order to minimize the prediction error, but the closer a model matches the physics, the better the model should work.

One commercially available hybrid type FCD has 9 chambers so it was thought that 9 successive flash computations would best fit the data (n=9). However, the best results were obtained by using only 2 steps of flash computation (n=2). While unexpected, the result is welcome. It furthers the goal to model FCDs as black boxes, independent of internal architecture.

The final model developed used the following parameters for this particular FCD:

| | |
|---|---|
| n | 2 |
| Sk | 0.616898904 |
| d | 3.712335032 |
| $a_1$ | 0.007118704 |
| $a_2$ | 1.278922809 |
| $b_1$ | 0.238248119 |
| $b_2$ | 0.000186341 |
| c | 1.405507151 |
| d | 0.05449507 |
| t | 3.60271E−06 |

The resulting performance had a Median error=0.47 psi and a Maximum Error=4.35 psi on 34.63 psi or 13%. The median error is close to the loop measurement error, so the results were deemed very good.

Implementation

The model was built as an Excel VBA application, but other software could be used such as a standalone Visual Studio application written in C++ or C#, or the like.

There are routines in Excel to implement the various equations. They are used as native operations in Excel spreadsheets, which are used as databases to hold the measurements and as data manipulation tools. The data from the tests, both the parameters and the results, are stored in columns with each row representing a different datapoint. The parameters to a model are also stored in cells in a spreadsheet so the model can be configured without changing the underlying VBA code.

One of the benefits of storing the model parameters as cells in a spreadsheet is that Excel Solver functionality can be used to optimize the model. Solver is set to minimize error by changing all the relevant model parameters. The error that is minimized can be the mean square error, the median error or the maximum error. The model is highly non-linear, so Solver settles on local solutions. Better solutions require disturbing the model. This can be done by varying some parameters, and letting Solver resolve while optimizing some parameters and keeping others constant or alternating error criteria.

FRR Scaling

Flow Resistance Rating or FRR is a useful tool for comparing the degree of restriction of different tools, but it can be misleading. Performance in FCDs is a vector quantity where the different attributes change at different rates. The various attributes are also highly non-linear.

Our tests showed that while two tools with differing architectures may have the same FRR, they offer very different performance as μ changes, as ṁ changes, and as a function of steam quality. It was also learned that performance within an architecture does not vary linearly with FRR. At the same time, it may be impractical to test a given architecture at a large number of FRRs, both in terms of tool cost and computation time. Therefore, a method is needed to predict how a tool will behave with differing FRR values.

Generally speaking, herein we have developed a new method to extrapolate the value of a reference FRR tool to other tools with the same architecture, but different ratings. Instead of scaling the output of the model, the data of the available characterizations is used to extrapolate what the characterization results would be to the different FRR. This estimated data set is then used to fit a new model for the uncharacterized FRR tool, which is then used to predict performance at a previously uncharacterized FRR.

Scaling Other Features

The above example proposes to scale the data from one FRR FCD in order to derive the model for a different FRR FCD of the same architecture. However, different measurement types or "attributes" scale differently, thus, treating them all the same does not yield good results. Thus, it is important to capture how differing attributes respond to changes in as μ changes, as m changes, and as a function of steam quality.

For example, it is preferred to collect separate data on viscosity sensitivity, reactivity to flow changes in monophasic flow and steam blocking efficacy. In our test program, responses to varying viscosity sensitivity are captured by the oil tests at various temperatures. Responses to flow changes are captured by performing unsaturated water flow tests. Finally, changes in monophasic flow and steam blocking efficacy are captured by performing steam tests. The scaling from one tool rating to the next usually mirror the impact on pressure differential across the FCD for water at a given flow rate. The data will scale differently on the effect of viscosity or the steam block. Even the effect of flow rate changes in monophasic flow may change.

The devices differing response to changing architecture, pressure, viscosity, phases changes and the like, can be captured separately and used to scale the oil, water and steam data by different factors. If more than 2 sizes of tool are tested, they may even be scaled using an exponential or a polynomial extrapolation and interpolation. Preferably, the oil/water/steam data is collected for more than two data points, e.g., three, four, five, six or more datapoints are collected. The more datapoints, the more accurate the scaling for a new FRR.

The scaled data set is then used to optimize a model for the interpolated or the extrapolated FRR. Ideally the data from the lowest, highest and middle FRRs would be used but the described approach works even if other FRR values are used. Of course, the more FRRs one tests, the better the results.

Reservoir Simulation

The optimized or fitted model can then be used in various ways, e.g., to predict performance of an FCD in a well being used for various steam based productions methods, such as SAGD, XSAGD, ES-SAGD, SW-SAGD, CSS, and all of the variants and combinations thereof.

In order to support SAGD well design one must have the also ability to simulate the performance of the well completion with the FCDs have been modeled. This implies addressing 2 different challenges:

1. Predict the ΔP through an FCD given the fluid properties and flow rate
2. Simulate the impact of the FCD on the reservoir, which implies modeling both the wellbore hydraulics and the movement of fluids through the reservoir Our preferred tool for reservoir simulation of thermal applications is CMG STARS. It has been enhanced through FLEXWELL to address not only the reservoir but also the hydraulics in the wellbore. However, other tools could be used, such as ECLIPSE software with Segmented Well from Schlumberger, NEXUS with SURFNET software from Halliburton or PROSPER with REVEAL software from Petroleum Experts.

Until now, the art has been thwarted by the lack of data on how FCDs behave at SAGD conditions. Currently, one simulates each FCD as a separate wellbore and then imposes constraints on bottom hole pressures, rates and steam-trap control. The behavior of the FCD is then forced into the simulation by changing the well constraints. In the producer well the live steam entry is limited. In the injector well the bottom hole pressure and steam injection rate are limited. If the STARS-FLEXWELL included appropriate FCD ΔP models, it could address these challenges.

The development of simulation therefore required 2 parallel developments:

1. The gathering of laboratory data to characterize FCDs under SAGD representative conditions.
2. A reservoir simulator capable of incorporating the behavior of FCDs.

Just having a model that predicts ΔP at the FCD is not enough. One also requires means to incorporate this capability onto the wellbore hydraulics and reservoir simulation. It defines the boundary conditions between the two domains and depends on the flow parameters. We have done this by converting the table keyword that is available in STARS to address by ΔP to obtain the resulting Flow rate (Q) or by Q to obtain ΔP. The platform developer is making the changes to allow the table addresses to include on Q, μ, ρ, steam fraction, water cut, and the like.

The model tables may be populated by the datasets obtained herein, either by testing existing devices or by modeling using the fitted model generated hereunder. Thus, the modified STARS or STARS-FLEXWELL suite enables accurate modelling of FCDs with varying FRR in the completion at a wide range of temperatures, pressures, viscosities, and % steam. In this way, optimal FCD configurations may be designed and tested for use in steam based oil recovery methods.

Modeling the FCD to interpolate and/or extrapolate a variety of FRR's under differing reservoir and injector conditions allowed changes to alter these variables and expand the dataset. The model may be used with a variety of parameters including differing reservoir conditions, injector conditions, and the like. Example parameters are provided in Table 2.

TABLE 2

| Model Parameters | | | |
|---|---|---|---|
| Parameter | Min | Max | Example |
| n | 1.333333333 | 17.31819512 | 7.229978099 |
| Sk0 | 1.06376E−06 | 5.362325 | 0.520884609 |
| Sk1 | −0.003308566 | 0.295378 | 0.009993129 |
| d | 0.637258774 | 36.43497 | 19.60741047 |
| a1 | −4.75036281 | 16417.93184 | −4.75036281 |
| a2 | −2528.312354 | 1059.012 | 59.37894001 |
| b1 | −1.167975338 | 0.861698 | 0.140346765 |
| b2 | −7.343479934 | 0.101222 | 0.026462386 |
| c | −136.3056097 | 74.5587 | 1.984239415 |
| d | −18.64436466 | 247.1155 | −1.314328357 |
| t | 829 | 16715857 | 2498494.766 |

Although a variety of variables are presented, they may fluctuate dependent upon the system, FCD, reservoir type, reservoir maturity, and other variables. In some embodiments a FCD having any number of chambers may be modeled with more or less chambers dependent upon the reservoir conditions and injection pressures. In one embodiment a 9 chamber FCD may be modeled with 1, 2, 3, 4, 5, 6, 7, 8, or 9 chambers. In Table 2, a 9 chambered FCD is modeled with 7 chambers.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

All of the references cited herein are expressly incorporated by reference in their entirety for all purposes. The discussion of any reference is not an admission that it is prior art to the present invention, especially any reference that may have a publication date after the priority date of this application. Incorporated references are listed again here for convenience:

U.S. Pat. No. 8,527,100 Method of providing a flow control device that substantially reduces fluid flow between a formation and a wellbore when a selected property of the fluid is in a selected range.

SPE-153706 (2012) Stalder, Test of SAGD Flow Distribution Control Liner System, Surmont Field, Alberta, Canada SPE:170045-MS (2014) Reil, et al., An Innovative Modeling Approach to Unveil Flow Control Devices' Potential in SAGD Application.

Zeng Q. et al., Comparative Study on Passive Flow control Devices by Numerical Simulation, Tech Science Press SL 9(3): 169-180 (2013), available online at www.techscience.com/doi/10.3970/s1.2013.009.169.pdf.

Birchenko V. M., Analytical Modelling of Wells with Flow Control Devices (PhD Thesis 2010), available at www.ros.hw.ac.uk/bitstream/10399/2349/1/BirchenkoV_0710_pe.pdf OTC-19811-MS (2009) Coronado, et el., New Inflow Control Device Reduces Fluid Viscosity Sensitivity and Maintains Erosion Resistance.

US-2015-0161304, filed Dec. 5, 2014.

The invention claimed is:

1. A method of modeling the behavior of a flow control device (FCD), comprising:

a) obtaining a first reference FCD of a given architecture;

b) measuring performance data from said reference FCD at a first flow resistance rating (FRR) to produce a first dataset;

c) measuring performance data from said first reference FCD at a second FRR to produce a second dataset;

d) using the first and second dataset to estimate a modified dataset corresponding to a third FRR;

e) fitting a model to said modified dataset to produce a fitted model; and f) using said fitted model to produce a prediction of FCD behavior of the reference FCD at said third FRR or a fourth FRR, thereby allowing prediction of production performance of a well fitted with FCDs using a reservoir simulator.

2. The method of claim 1, wherein said performance data includes measuring FCD performance at two or more viscosities, two or more steam qualities, and two or more pressures, and wherein each is separately scaled to generate a modified dataset.

3. A method of modeling the behavior of an FCD in a steam based oil recovery well, comprising:

a) obtaining a first reference FCD of a given architecture;

b) measuring performance data from said reference FCD at a first FRR to produce a first dataset, wherein said first dataset includes oil tests at two or more temperatures, unsaturated water flow tests at two or more pressures, and steam tests at two or more steam percentages;

c) measuring performance data from said reference FCD at a second FRR to produce a second dataset, wherein said second dataset includes oil tests at two or more temperatures, unsaturated water flow tests at two or more pressures, and steam tests at two or more steam percentages;

d) using the first and second data set to estimate a modified dataset corresponding to a third FRR, wherein data from oil tests, unsaturated water flow tests and steam tests are each scaled separately;

e) fitting a model to said modified dataset to produce a fitted model; and f) using said fitted model to produce a prediction of FCD behavior of the reference FCD at said third FRR or a fourth FRR to produce a final fitted model, wherein said final fitted model is used in a reservoir simulator to predict the performance of a steam based oil recovery well.

4. The method of claim 1 or 2, wherein said model predicts a differential pressure of a fluid that includes both water and steam through stages separated by chokes of a well flow control device based on the following equation to estimate the amount of steam that flashes:

$$((H_{Li}-H_{Lo})/(H_{Vo}-H_{Lo}))*Sk,$$

where $H_{Li}$ is liquid enthalpy at pressure going in the choke, $H_{Lo}$ is liquid enthalpy at pressure out of the choke, $H_{Vo}$ is vapor enthalpy at pressure out of the choke and Sk is a scaling factor for amount of the steam that is released between the stages; and simulating hydrocarbon production using the differential pressure that is predicted.

5. The method of claim 1 or 2, wherein said fitted model is used to predict the performance of a steam assisted gravity drainage (SAGD) well.

6. A method of predict the performance of a SAGD well completed with a plurality of FCDs, comprising:

a) obtaining a first reference FCD of a given architecture;

b) measuring performance data from said reference FCD at a first flow resistance rating (FRR) to produce a first dataset;

c) measuring performance data from said reference FCD at a second FRR to produce a second dataset;

d) using the first and second data set to estimate a modified dataset corresponding to a third FRR;

e) fitting a model to said modified dataset to produce a fitted model;

f) using said fitted model to predict the performance of the reference FCD at a third FRR or a fourth FRR; and g) using said fitted model in a reservoir simulator model to predict the production performance of a SAGD well fitted with test FCDs having a test FRR.

7. The method of claim 6, wherein said performance data includes measuring performance of said FCD at two or more viscosities, two or more steam qualities, and two or more pressures, and wherein each is separately scaled to generate a modified dataset.

8. The method of claim 6, wherein a variety of test FRRs are tested in step g.

9. The method of claim 6, wherein a variety of test FCDs having different architectures are tested in step g.

10. The method of claim 6, wherein a variety of test FRRs are tested and a variety of test FCDs having different architectures are tested in step g.

11. The method of any one of claims 6-10, wherein said model predicts a differential pressure of a fluid that includes both water and steam through stages separated by chokes of a well flow control device based on the following equation to estimate the amount of steam that flashes:

$$((H_{Li}-H_{Lo})/(H_{Vo}-H_{Lo}))*Sk,$$

where $H_{Li}$ is liquid enthalpy at pressure going in the choke, $H_{Lo}$ is liquid enthalpy at pressure out of the choke, $H_{Vo}$ is vapor enthalpy at pressure out of the choke and Sk is a scaling factor for amount of the steam that is released between the stages; and simulating hydrocarbon production using the differential pressure that is predicted.

* * * * *